US005933983A

United States Patent [19]

Jeon

[11] Patent Number: 5,933,983

[45] Date of Patent: Aug. 10, 1999

[54] SHOCK-ABSORBING SYSTEM FOR SHOE

[76] Inventor: Jung-Hyo Jeon, 980-13, Susung-4-ga, Susung-gu, Daegu-kwangyeoksi, Rep. of Korea

[21] Appl. No.: 09/104,816

[22] Filed: Jun. 25, 1998

[30] Foreign Application Priority Data

Apr. 14, 1998 [KR] Rep. of Korea ..... 98-13303

[51] Int. Cl.[6] ..... A43B 13/20; A43B 21/26

[52] U.S. Cl. ..... 36/29; 36/27; 36/35 B; 36/3 B

[58] Field of Search ..... 36/28, 29, 37, 36/35 R, 35 B, 71, 38, 27

[56] References Cited

U.S. PATENT DOCUMENTS

| | | | |
|---|---|---|---|
| 1,711,302 | 4/1929 | Belpedio | 36/35 B |
| 2,532,742 | 12/1950 | Stoiner | 36/35 B |
| 4,815,221 | 3/1989 | Diaz | 36/27 |
| 4,843,737 | 7/1989 | Vorderer | 36/27 |
| 4,881,329 | 11/1989 | Crowley | 36/27 |
| 5,175,946 | 1/1993 | Tsai | 36/29 |
| 5,224,278 | 7/1993 | Jeon | 36/27 |
| 5,408,760 | 4/1995 | Tse et al. | 36/3 B |
| 5,704,137 | 1/1998 | Dean et al. | 36/28 |
| 5,815,950 | 10/1998 | Wang | 36/29 |

FOREIGN PATENT DOCUMENTS

| | | | |
|---|---|---|---|
| 2221378 | 2/1990 | United Kingdom | 36/29 |
| 2225212 | 5/1990 | United Kingdom | 36/28 |
| 2244200 | 11/1991 | United Kingdom | 36/29 |

*Primary Examiner*—Paul T. Sewell
*Assistant Examiner*—J. Mohandesi
*Attorney, Agent, or Firm*—McCormick, Paulding & Huber

[57] ABSTRACT

A shock-absorbing system for a shoe comprises an upper shell having a forefoot portion, a midfoot portion and a rearfoot portion; a sole unit having an insole, a midsole and an outsole, the midsole or outsole being formed with a depression; a cap member received in the depression formed in the sole unit while defining an inner space of a desired cross-section, the cap member having a plurality of cushioning arms which are spaced apart from each other and have a arch-shaped configuration; and a fluid-filled bladder member nested onto the plurality of cushioning arms of the cap member.

13 Claims, 6 Drawing Sheets

SHOCK-ABSORBING SYSTEM FOR SHOE

BACKGROUND OF THE INVENTION

1. Field of the Invention

The present invention relates to a shock-absorbing system for a shoe, and more particularly to a shock-absorbing system for a shoe, which has a compact structure and effectively absorbs and dissipates a shock imposed to a foot of a shoe wearer upon walk or exercise and rebounds an accumulated energy, whereby comfortableness and stability of the foot are simultaneously ensured.

2. Description of the Related Art

In our daily life, our shoes are the instruments that bear the weight of our body and are constantly subjected to the impact of that weight throughout the day. Our shoes are, therefore, the most important medium through which the external force acts on the body.

Accordingly, shoe manufacturers are seeking ways to provide a shoe that is stable and yet comfortable. Typically, stability of a shoe sole is enhanced by increasing its rigidity, and comfortableness is enhanced by increasing cushioning provided in a shoe. Thus, the more stable the shoe, the less cushioning that is provided, and conversely, the more cushioning that is provided, the less stable the shoe. As a result, stability is often sacrificed for the sake of comfortableness, and vice versa.

In this century, introduction of shoes designed specifically for athletic purposes has highlighted this problem. Many athletic activities involve running and jumping that translate to high impact forces on the foot. As a result, today's typical athletic shoe sole includes a cushion midsole layer that is sandwiched between the insole and outsole layers of the sole. This midsole layer is usually made of a foam material to provide maximum cushion effect to the foot.

However, the effect of using the midsole is much the same as providing an ordinary "kitchen sponge" in a pair of dress shoes, that is, only minimal impact absorption is provided. Moreover, the foam cushion material does little to stabilize the foot within the shoe. In particular, the foam cushion has no stability along the edge of the midsole, an area which without support can cause the foot to roll over upon impact with the ground (pronation and supination). Therefore, a balance between comfortableness and stability is essential in any performance athletic shoe.

As attempts to satisfy the requirements as described above needed in shoe, various methods, such as utilizing different density foam in select areas of a midsole, using a midsole having air cushion, etc. are disclosed in the art. One problem associated with the former is that the harder density foam is often so hard that it does not compress at all under the forces encountered during typical athletic activity, and other problem encountered in the latter is that the structure of shoe is complex and thereby the shoe becomes expensive while not perfectly satisfying the requirements.

SUMMARY OF THE INVENTION

Accordingly, the present invention has been made in an effort to solve the problems occurring in the prior art, and an object of the present invention is to provide a shock-absorbing system for a shoe, which has a compact structure and effectively absorbs and dissipates a shock imposed to a foot of a shoe wearer upon walk or exercise and rebounds an accumulated energy, whereby comfortableness and stability of the foot are simultaneously ensured.

According to one aspect of the present invention, there is provided a shock-absorbing system for a shoe comprising: an upper shell having a forefoot portion, a midfoot portion and a rearfoot portion; a sole unit having an insole, a midsole and an outsole, the midsole or outsole being formed-with a depression; a cap member received in the depression formed in the sole unit while defining an inner space of a desired cross-section, the cap member having a plurality of cushioning arms which are spaced apart from each other and have a arch-shaped configuration; and a fluid-filled bladder member nested onto the plurality of cushioning arms of the cap member.

According to another aspect of the present invention, the cap member includes a body having a cylinder-shaped configuration, and one end of each cushioning arm is connected to a lower end of the body and the other end of each cushioning arm is connected to a bottom portion provided at a center region of the lower end of the body.

According to another aspect of the present invention, the fluid-filled bladder member is nested onto the plurality of cushioning arms while being received in the inner space within the body.

According to another aspect of the present invention the fluid-filled bladder member has a peripheral portion of a donut-shaped configuration and a center portion of a semisphere-shaped configuration, the center portion being disposed at a center part of the peripheral portion and integrally connected to the peripheral portion, the center portion downward and/or upward projecting from a plane of the peripheral portion.

According to another aspect of the present invention, the center portion is seated onto the bottom portion and the peripheral portion is seated onto the plurality of cushioning arms.

According to another aspect of the present invention, a plurality of slits are formed on a wall of the body such that each of them is communicated with a gap between two adjacent cushioning arms, respectively.

According to another aspect of the present invention, a plurality of projections extending in a longitudinal direction are formed onto an outer surface of the body between two adjacent slits, respectively.

According to another aspect of the present invention, the depression is formed below at least one of the forefoot portion, midfoot portion and rearfoot portion of the upper shell.

According to still another aspect of the present invention, the body has a configuration in which a first half having a semicircular cross-section and a second half having a 'V'-shaped cross-section are integrally coupled to each other.

According to yet still another aspect of the present invention, width of each cushioning arm is gradually decreased toward a center of the body.

By the features of the present invention, when impacts against a heel portion are started, a weight of a shoe wearer applies a force to a sole unit below a rearfoot portion, and according to this, a fluid-filled bladder member is compressed to first absorb a shock. Then, the force which compressed the fluid-filled bladder member compresses a plurality of cushioning arms of a cap member against a bottom surface of a depression, and according to this, each of the cushioning arms is bent to second absorb the shock. When the weight of the shoe wearer is moved from the rearfoot portion to a forefoot portion, a load applied to the fluid-filled bladder member and the cap member is removed, and if the load is removed, the fluid-filled bladder member and the cap member are returned to their original shape to rebound an accumulated energy. Therefore, according to the present invention, it is possible to effectively absorb and dissipate a shock imposed to a foot of a shoe wearer upon walk or exercise and rebound an accumulated energy, by a compact structure, whereby comfortableness and stability of the foot are simultaneously provided.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1A:
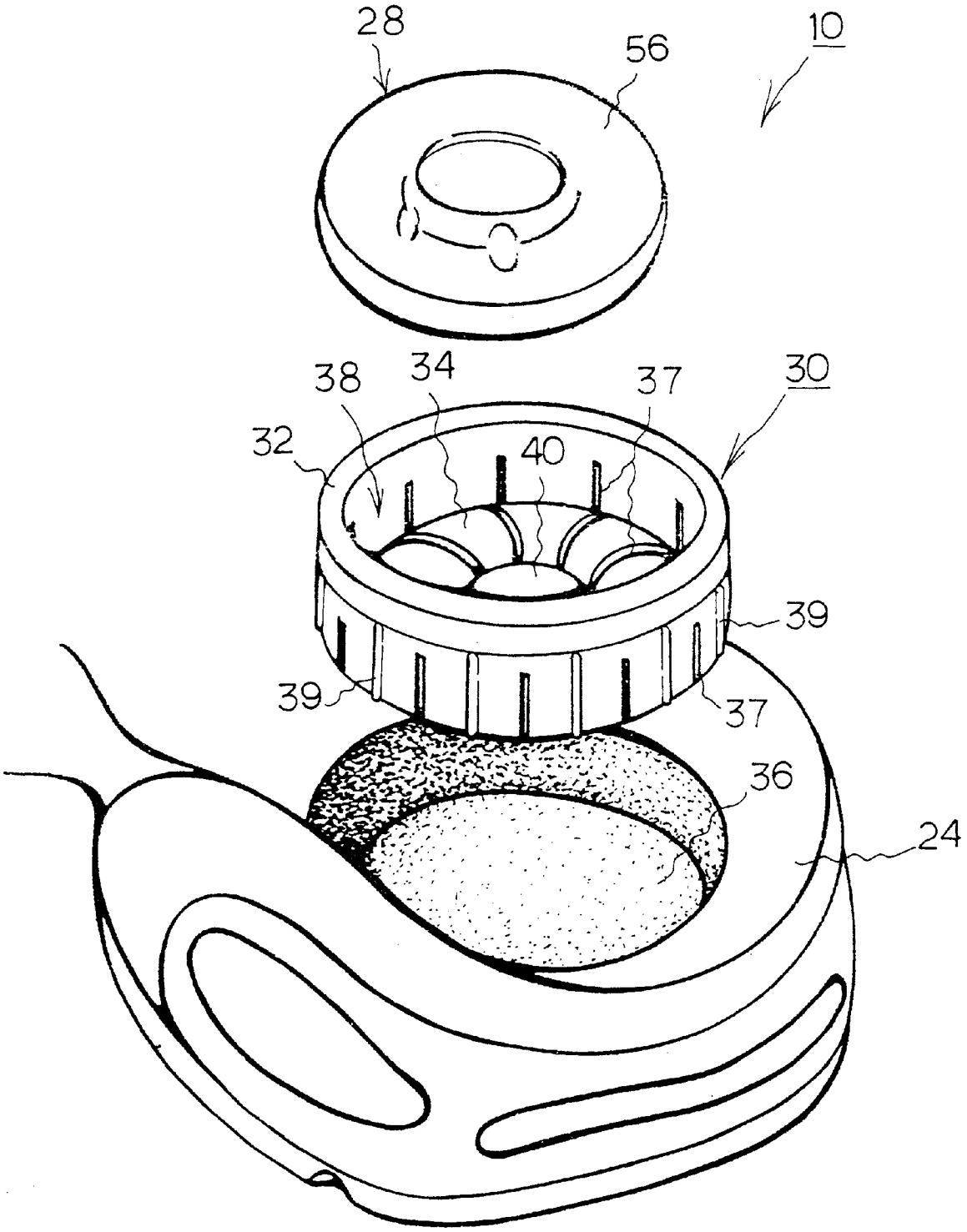
FIG. 1A is a partial exploded perspective view illustrating a construction of a shock-absorbing system for shoe in accordance with an embodiment of the present invention.
Figure 1B:
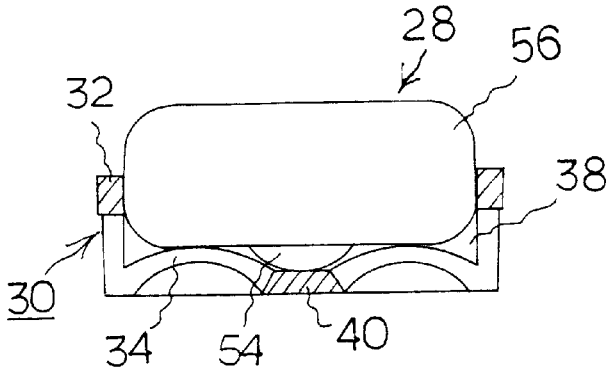
FIG. 1B is a cross-sectional view illustrating a structure in which a fluid-filled bladder member and a cap member used in the shock-absorbing system for shoe of FIG. 1A cooperate to each other.
Figure 1C:
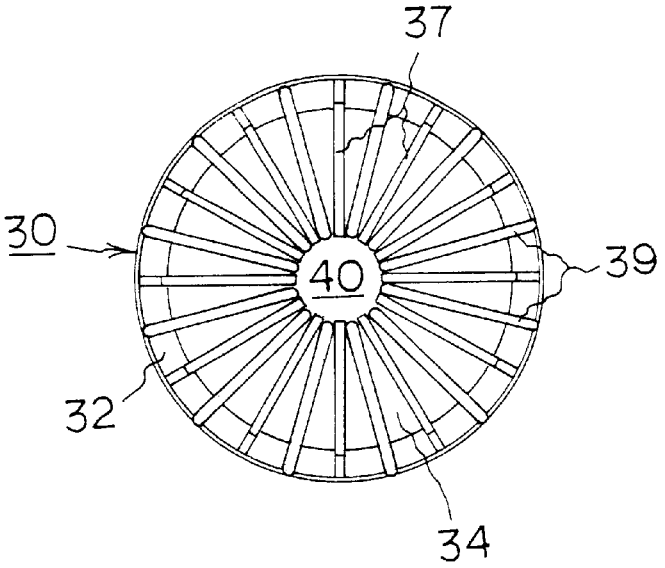
FIG. 1C is a bottom view for the fluid-filled bladder member and cap member of FIG. 1B.
Figure 1D:
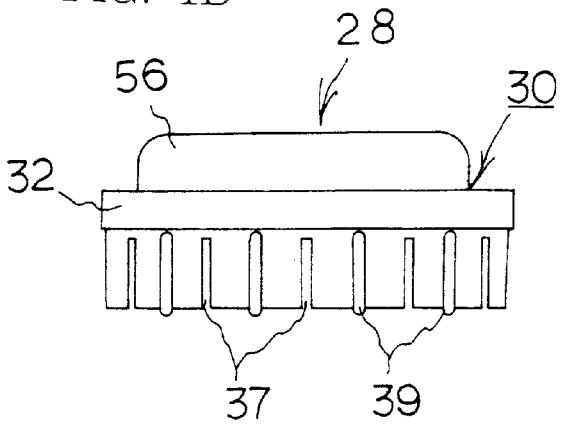
FIG. 1D is a front view for the fluid-filled bladder member and cap member of FIG. 1B.
Figure 1E:
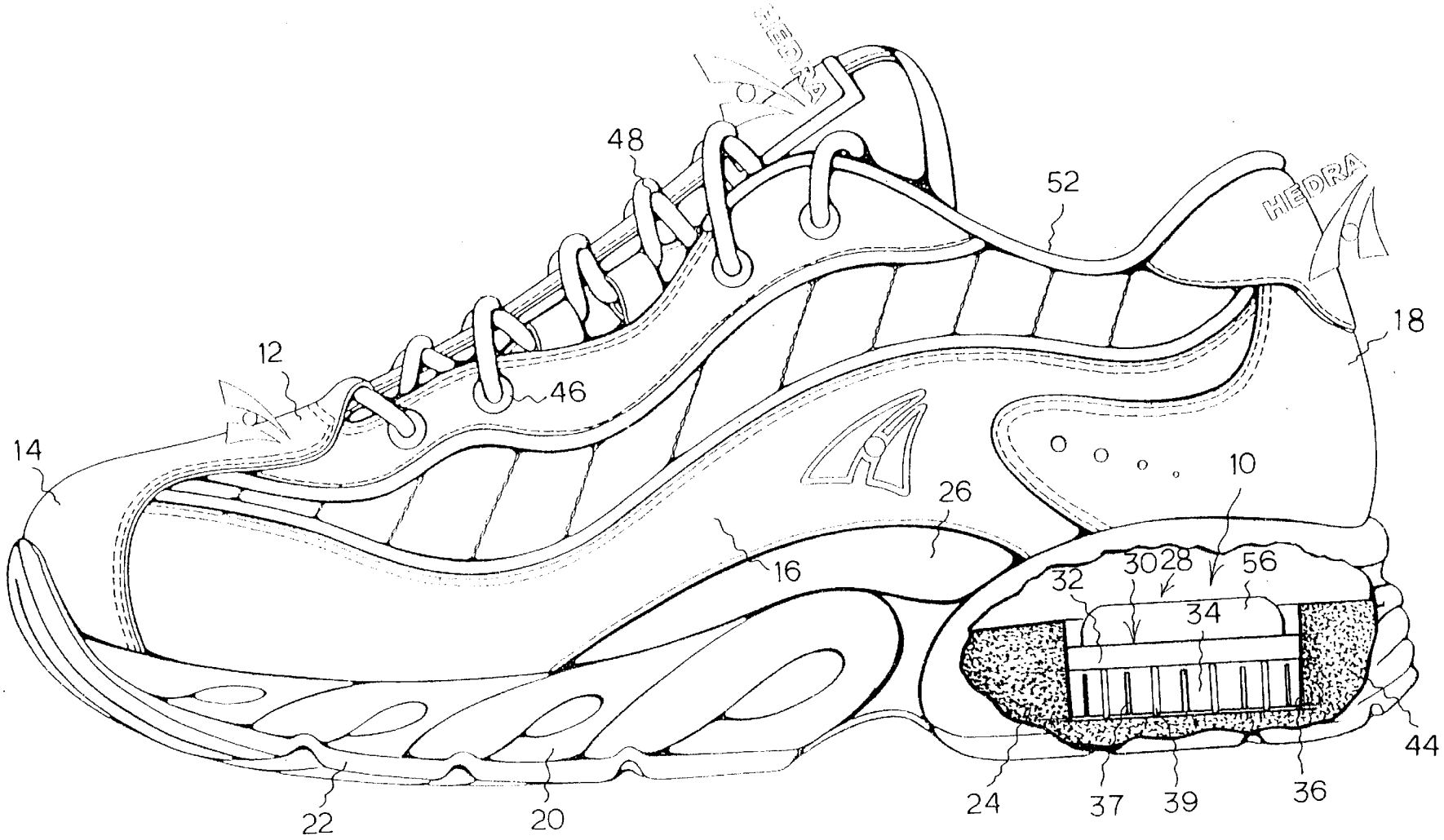
FIG. 1E is a partially broken front view illustrating a state that the shock-absorbing system of the present invention is provided in a hill portion of shoes.

Reference will now be made in greater detail to a preferred embodiment of the invention, an example of which is illustrated in the accompanying drawings. Wherever possible, the same reference numerals will be used throughout the drawings to refer to the same or like parts.

Referring to FIGS. 1A to 1E, there is illustrated a shock-absorbing system for shoe in accordance with a first embodiment of the present invention.

A shock-absorbing system for shoe according to the present invention includes a fluid-filled bladder member 28 and a cap member 30.

A shoe in which the present shock-absorbing system 10 is installed includes an upper shell 12 coupled to a sole unit 20. The upper shell 12 can be made of any suitable material such as canvas or leather. As with conventional upper shells, the upper shell 12 includes a foot inserting opening 52 through which a foot of a shoe wearer is inserted. An eyestay 46 is provided for receiving shoe laces 48 or other fastening means for securing the upper shell 12 about the foot of the shoe wearer. The upper shell 12 includes a forefoot portion 14, a midfoot portion 16 and a rearfoot portion 18.

The sole unit 20 includes an outsole 22, a midsole 24 and an insole 26. The outsole 22 is preferably made of rubber or urethane, although other suitable durable material may be used. The outsole 22 extends from the forefoot portion 14 to the rearfoot portion 18 of the upper shell 12, and may be a single piece of material or several individual pieces. The outsole 22 is attached to the midsole 24 by any suitable means such as an adhesive. Similarly, the midsole 24 is attached to the insole 26 by any suitable means including adhesive.

According to the present invention, a heel portion 44 is formed in the midsole 24 below the rearfoot portion 18 of the upper shell 12, and a depression is defined in the heel portion 44. The cap member 30 is received in the depression 36. The cap member 30 includes a body having substantially a cylinder-shaped configuration. A plurality of cushioning arms 34 extending toward a center of the body 32 are connected at their one end to a lower end of the body 32. Each of the plurality of cushioning arms 34 is upward convex to form substantially a arch-shaped configuration. A width of each cushioning arm 34 is gradually decreased toward the center of the body 32. The plurality of cushioning arms 34 are separated from each other, and the other end of each cushioning arm 34 is connected to a bottom portion 40 disposed in a center region of the body 32.

The body 32 defines an inner space 38, and the fluid-filled bladder member 28 is fitted into the inner space 38 to be nested onto the plurality of cushioning arms 34. The fluid-filled bladder member 28 is filled with a fluid, e.g. air, at a proper pressure. The fluid-filled bladder member 28 includes a center portion 54 and a peripheral portion 56 which are integrally formed. The center portion 54 has substantially a semisphere-shaped configuration, and the peripheral portion 56 has substantially a donut-shaped configuration. The center portion 54 is projected downward beyond a plane of the peripheral portion 56. The center portion 54 is seated onto the bottom portion 40 and the peripheral portion 56 is seated onto the plurality of cushioning arms 34.

A wall of the body 32 is formed with a plurality of slits 37 each of which is communicated with a gap between two adjacent cushioning arms 34. Between two adjacent slits 37, a plurality of projections 39 are formed on an outer surface of the body 32, respectively. The plurality of projections 39 extend in the longitudinal direction.

When impacts against the heel portion 44 are started, a weight of the shoe wearer applies a force to the sole unit 20 below the rearfoot portion 18, and according to this, the fluid-filled bladder member 28 is compressed to first absorb a shock. Then, the force which compressed the fluid-filled bladder member 28 compresses the cushioning arms 34 of the cap member 30 against a bottom surface of the depression 36, and according to this, each of the cushioning arms 34 is bent to second absorb the shock.

The fluid-filled bladder member 28 and the cap member 30 according to the present invention were created by applying to them a combination of ribs of the human body and muscles encompassing the ribs. For example, the fluid-filled bladder member 28 is a thing that is provided by applying the muscles, and the cap member 30 is a thing that is provided by applying the ribs.

The fluid-filled bladder member 28 and the cap member 30 perfectly absorb a vertical impact force applied to the foot of the shoe wearer and dissipates the impact force in a horizontal direction. Accordingly, even when the foot of the shoe wearer is not vertically seated onto a plane of the sole unit 20 and is slopingly seated onto the plane of the sole unit 20, the fluid-filled bladder member 28 and the cap member 30 prevent the shoe wearer from falling down while they are compressed and deformed, whereby the stability of the shoe wearer is maintained. Accordingly, the shock-absorbing system of the present invention can prevent pronation and supination of the shoe wearer.

When the weight of the shoe wearer is moved from the rearfoot portion 18 to the forefoot portion 14, a load applied to the fluid-filled bladder member 28 and the cap member 30 is removed, and if the load is removed, the fluid-filled bladder member 28 and the cap member 30 are returned to their original shape to rebound an accumulated energy.

As described above, by the fact that the plurality of slits 37 are formed in the cylindrical body 32, shock-absorbing capability of the plurality of cushioning arms 34 are improved. Also, by the fact that the plurality of projections extending in the longitudinal direction are formed in the outer surface of the cylindrical body 32, a contact area between wall portion defining the depression 36 and the body 32 is reduced, whereby shape restoration property is maximized and the force for rebounding upward the fluid-filled bladder member 28 received in the inner space 38 is increased.

According to a preferred embodiment of the present invention, the shock-absorbing system as shown in FIGS. 1A to 1E can be commonly used in sports shoes such as baseball shoes, tennis shoes, basketball shoes, jogging shoes, etc., walking shoes, casual shoes, or dress shoes.

Figure 2A:
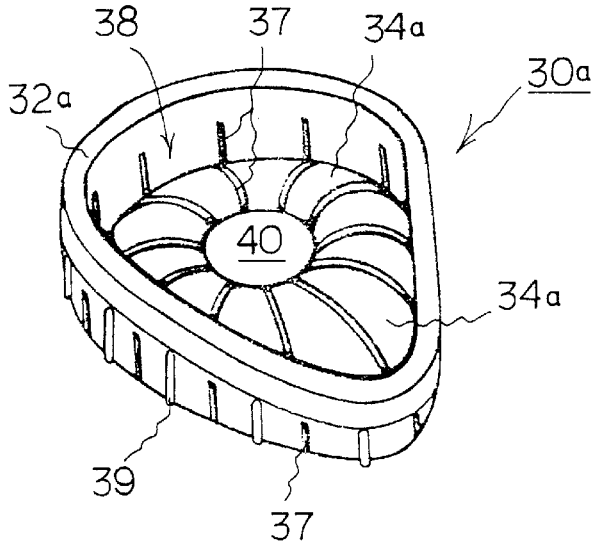
FIG. 2A is a perspective view independently showing another shock-absorbing system for shoe in accordance with another embodiment of the present invention.
Figure 2B:
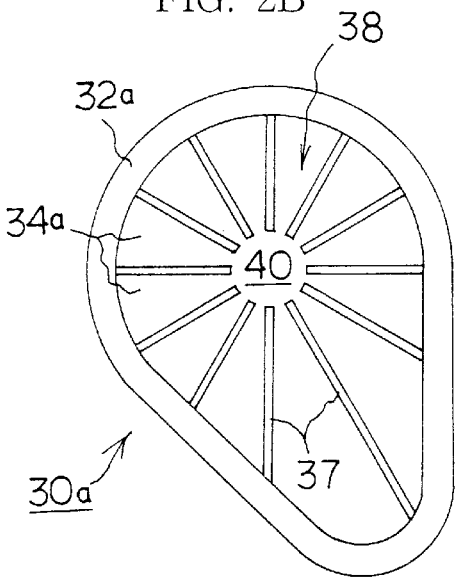
FIG. 2B is a plan view of the shock-absorbing system of FIG. 2A.
Figure 2C:
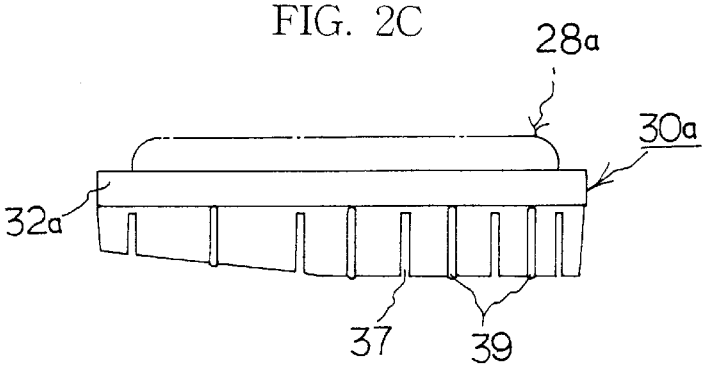
FIG. 2C is a side view of the shock-absorbing system of FIG. 2A.

Referring to FIGS. 2A to 2C, there is illustrated another shock-absorbing system for shoe in accordance with a second embodiment of the present invention.

The shock-absorbing system of the present embodiment includes a cap member 30*a* and a fluid-filled bladder member 28*a*. The cap member 30*a* includes a body 32*a*. The body 32*a* has a configuration in which a first half having a semicircular cross-section and a second half having a 'V'-shaped cross-section are integrally coupled to each other. A plurality of cushioning arms 34*a* extending toward a center of the body 32*a* are connected at their one end to a lower end of the body 32*a*. Each of the plurality of cushioning arms 34*a* is upward convex to form substantially a arch-shaped configuration. A width of each cushioning arm 34*a* is gradually decreased toward the center of the body 32*a*. The plurality of cushioning arms 34*a* are separated from each other, and the other end of each cushioning arm 34*a* is connected to a bottom portion 40 disposed in a center region of the body 32*a*.

The body 32*a* defines an inner space 38, and the fluid-filled bladder member 28*a* is fitted into the inner space 38 to be nested onto the plurality of cushioning arms 34*a*. A wall of the body 32 is formed with a plurality of slits 37 each of which is communicated with a gap between two adjacent cushioning arms 34*a*. Between two adjacent slits 37, a plurality of projections 39 are formed on an outer surface of the body 32*a*, respectively. The plurality of projections 39 extend in the longitudinal direction.

The shock-absorbing system of the present embodiment can be commonly used in sports shoes such as tennis shoes, basketball shoes, baseball shoes, jogging shoes, etc., which performs movement of a large extent and requires a high shock-absorbing capability.

As a result, by the shock-absorbing system for shoe of the present invention, constructed as mentioned above, it is possible to effectively absorb and dissipate a shock imposed to a foot of a shoe wearer upon walk or exercise and rebound an accumulated energy, by a compact structure, whereby comfortableness and stability of the foot are simultaneously provided.

In the drawings and specification, there have been disclosed typical preferred embodiments of the invention and, although specific terms are employed, they are used in a generic and descriptive sense only and not for purposes of limitation, the scope of the invention being set forth in the following claims. For example, although it is explained in the above embodiments that the depression 36 is formed below the rearfoot portion 18 of the upper shell 12, it is possible to form the depression 36 below at least one of the forefoot portion 14, midfoot portion 16 and rearfoot portion 18 of the upper shell 12. Also, it can be readily understood that at least two pairs of cap member 30 and 30*a* and fluid-filled bladder member 28 and 28*a* can be provided to stack them one on the other.

What is claimed is:

1. A shock-absorbing system for a shoe comprising:

an upper shell having a forefoot portion, a midfoot portion and a rearfoot portion;

a sole unit having an insole, a midsole and an outsole, said midsole or outsole being formed with a depression;

a cap member received in said depression formed in said sole unit while defining an inner space of a desired cross-section, said cap member having a plurality of cushioning arms which are spaced apart from each other and have a arch-shaped configuration; and a fluid-filled bladder member nested onto said plurality of cushioning arms of said cap member.

2. A shock-absorbing system for a shoe as claimed in claim 1, wherein said cap member includes a body having a cylinder-shaped configuration, and one end of each cushioning arm is connected to a lower end of said body and the other end of each cushioning arm is connected to a bottom portion provided at a center region of said lower end of said body.

3. A shock-absorbing system for a shoe as claimed in claims 1 or 2, wherein said fluid-filled bladder member is nested onto said plurality of cushioning arms while being received in said inner space within said body.

4. A shock-absorbing system for a shoe as claimed in claim 1, wherein said fluid-filled bladder member has a peripheral portion of a donut-shaped configuration and a center portion of a semisphere-shaped configuration, said center portion being disposed at a center part of said peripheral portion and integrally connected to said peripheral portion, said center portion downward and/or upward projecting from a plane of said peripheral portion.

5. A shock-absorbing system for a shoe as claimed in claims 1, wherein said center portion is seated onto said bottom portion and said peripheral portion is seated onto said plurality of cushioning arms.

6. A shock-absorbing system for a shoe as claimed in claim 1, wherein a plurality of slits are formed on a wall of said body such that each of them is communicated with a gap between two adjacent cushioning arms, respectively.

7. A shock-absorbing system for a shoe as claimed in claim 1, wherein a plurality of projections extending in a longitudinal direction are formed onto an outer surface of said body between two adjacent slits, respectively.

8. A shock-absorbing system for a shoe as claimed in claim 1, wherein said depression is formed below at least one of said forefoot portion, midfoot portion and rearfoot portion of said upper shell.

9. A shock-absorbing system for a shoe as claimed in claim 1, wherein said body has a configuration in which a first half having a semicircular cross-section and a second half having a 'V'-shaped cross-section are integrally coupled to each other.

10. A shock-absorbing system for a shoe as claimed in claim 1, wherein the width of each cushioning arm is gradually decreased toward a center of said body.

11. A shock-absorbing system for a shoe as claimed in claim 2, wherein said fluid-filled bladder member is nested onto said plurality of cushioning arms while being received in said inner space within said body.

12. A shock-absorbing system for a shoe as claimed in claim 4, wherein said center portion is seated onto said bottom portion and said peripheral portion is seated onto said plurality of cushioning arms.

13. A shock-absorbing system for a shoe as claimed in claim 9, wherein the width of each cushioning arm is gradually decreased toward a center of said body.

* * * * *

UNITED STATES PATENT AND TRADEMARK OFFICE

CERTIFICATE OF CORRECTION

PATENT NO. : 5,933,983

DATED : August 10, 1999

INVENTOR(S) : Jung-Hyo Jeon

It is certified that error appears in the above-identified patent and that said Letters Patent is hereby corrected as shown below:

Column 3:

Line 20, delete "hill" and substitute --heel--;

After line 20, insert

Figure 1F:
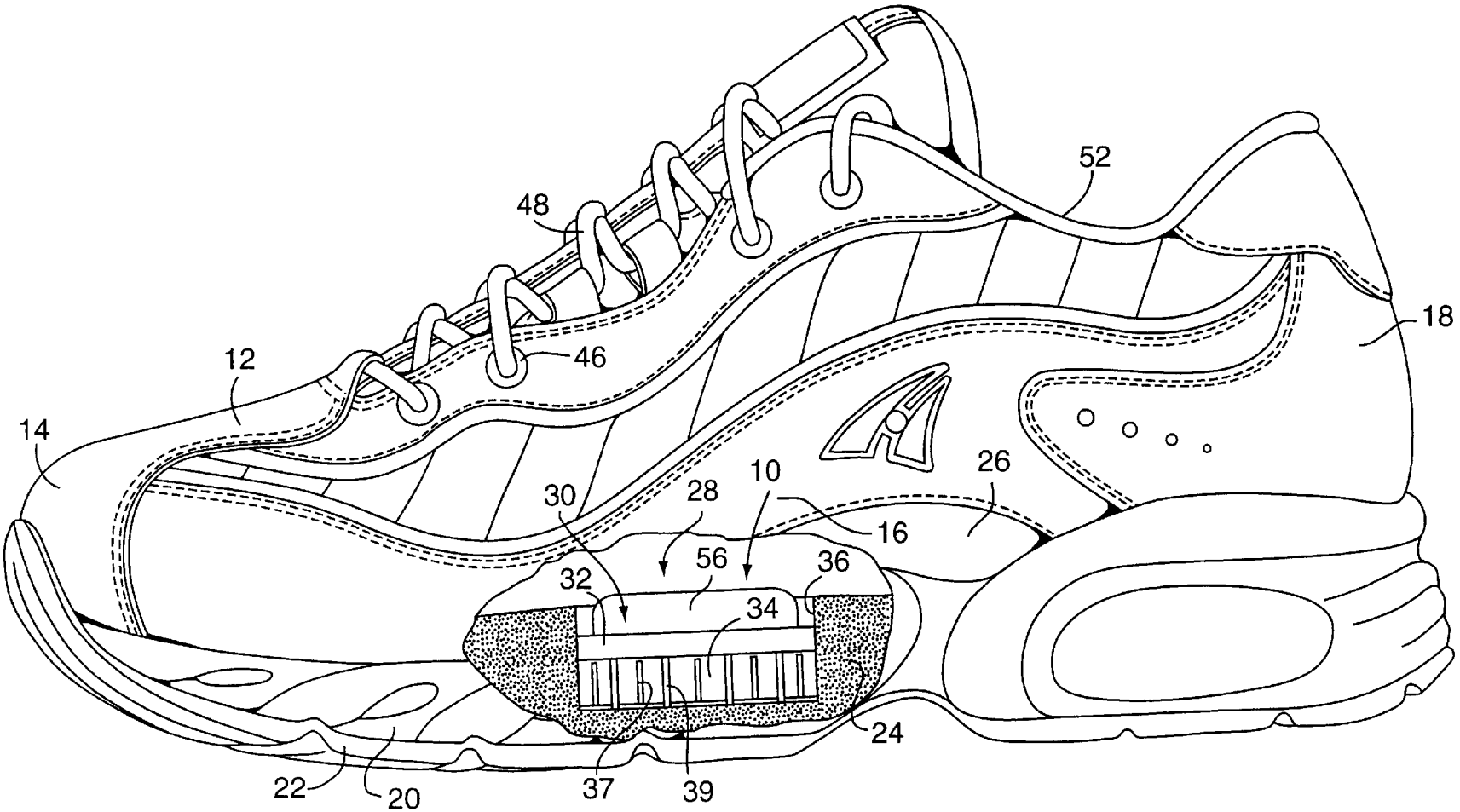

--FIG. 1F is a partially broken front view illustrating a state that the shock-absorbing system of the present invention is provided in a midfoot portion of shoes.

Figure 1G:
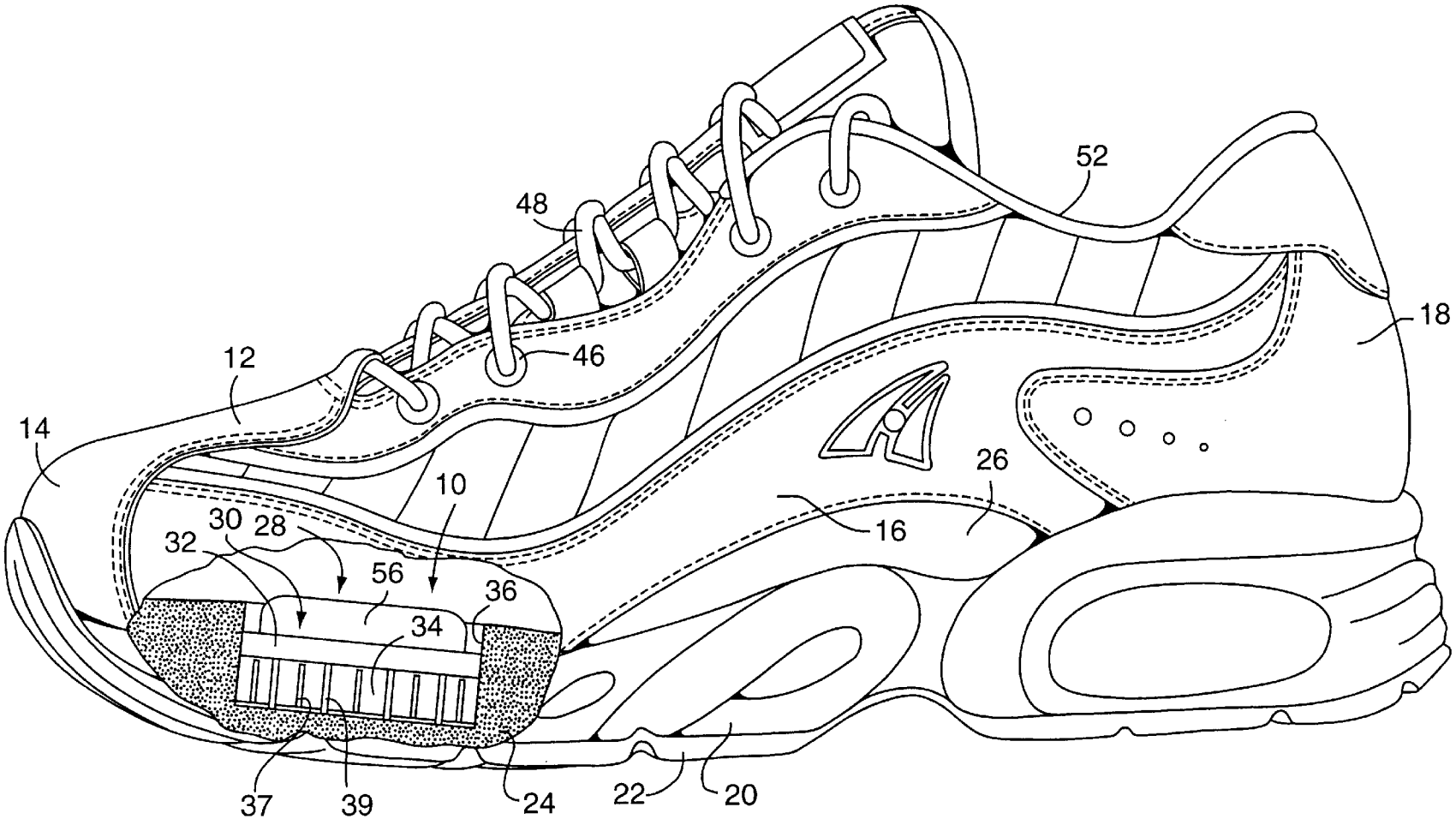

FIG. 1G is a partially broken front view illustrating a state that the shock-absorbing system of the present invention is provided in a forefoot portion of shoes.--

Line 36, delete "1E" and substitute --1G--.

Column 5:

Line 6, delete "1E" and substitute --1G--.

UNITED STATES PATENT AND TRADEMARK OFFICE

CERTIFICATE OF CORRECTION

PATENT NO. : 5,933,983

DATED : August 10, 1999

INVENTOR(S) : Jung-Hyo Jeon

It is certified that error appears in the above-identified patent and that said Letters Patent is hereby corrected as shown below:

In the Claims:

Claim 3:

Line 2, delete "claims 1 or 2" and substitute --claim 1--.

Signed and Sealed this

Twenty-fifth Day of April, 2000

*Attest:*

Q. TODD DICKINSON

*Attesting Officer*

*Director of Patents and Trademarks*